US005802625A

United States Patent [19]

Whittaker

[11] Patent Number: 5,802,625

[45] Date of Patent: Sep. 8, 1998

[54] SANITARY UNIT

[75] Inventor: Matthew Ronald Whittaker, Redditch, United Kingdom

[73] Assignee: Waterloo Products Limited, United Kingdom

[21] Appl. No.: 753,703

[22] Filed: Nov. 27, 1996

Related U.S. Application Data

[63] Continuation-in-part of PCT/GB95/01204 filed May 26, 1995 published as WO95/32659 on Dec. 7, 1995.

[51] Int. Cl.[6] ..... A47K 11/04

[52] U.S. Cl. ..... 4/300; 4/408; 4/902

[58] Field of Search ..... 4/300, 378, 405, 4/408, 449, 464, 223, 480, 483, 902

[56] References Cited

U.S. PATENT DOCUMENTS

| | | | |
|---|---|---|---|
| 341,464 | 5/1886 | Ellis | 4/464 |
| 815,969 | 3/1906 | Macfarlane | 4/464 |
| 3,680,151 | 8/1972 | Boardman et al. | 4/902 |
| 4,069,522 | 1/1978 | Messmer et al. | 4/483 |
| 4,174,544 | 11/1979 | Furusawa | 4/902 |
| 4,193,142 | 3/1980 | Henningfield | 4/483 |
| 5,535,456 | 7/1996 | Chai | 4/449 |

FOREIGN PATENT DOCUMENTS

| | | | |
|---|---|---|---|
| 847551 | 7/1970 | Canada | 4/300 |
| 3108457 | 8/1898 | Germany . | |
| 102654 | 9/1982 | Germany . | |
| 300119 | 5/1992 | Germany | 4/300 |

*Primary Examiner*—Charles R. Eloshway
*Attorney, Agent, or Firm*—Ira S. Dorman

[57] ABSTRACT

A sanitary unit such as a child's potty or a commode for the elderly or infirm, includes a container (13) for receiving human waste. A seat (24) is arranged relative to the container such that waste from a person sitting on the seat is received in the container. A water reservoir (10) communicates with the container by way of a valve (12). A valve actuator is responsive to the weight of a person sitting on the seat so as to open the valve and to release water from the reservoir into the container in response to a person sitting on the seat.

10 Claims, 3 Drawing Sheets

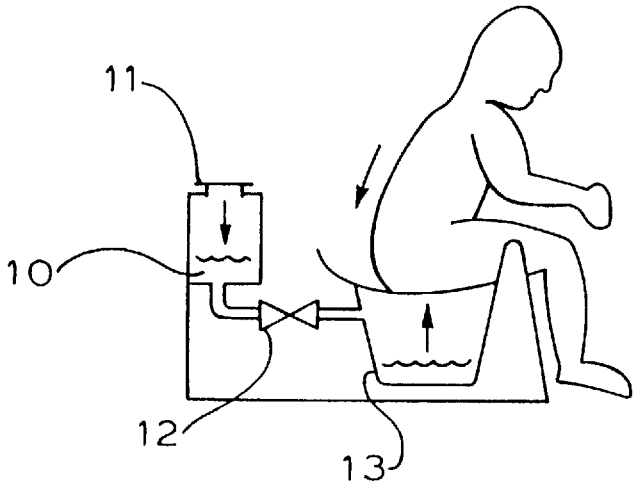
FIG 1
FIG 2
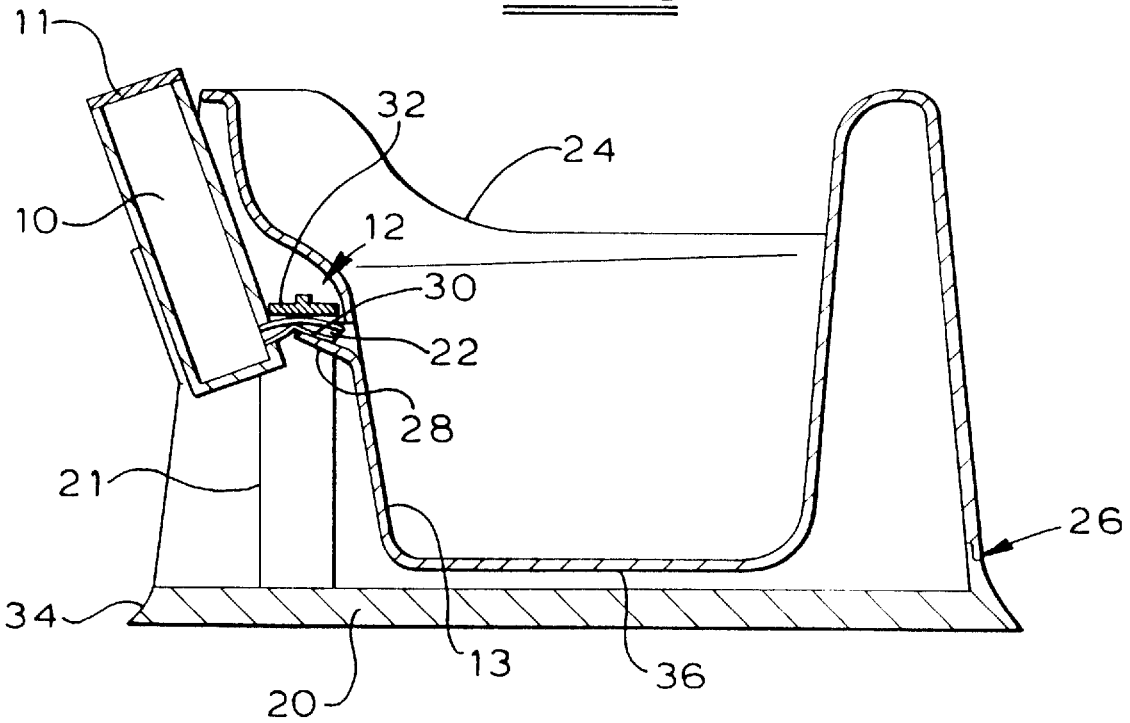

SANITARY UNIT

CROSS REFERENCE TO RELATED APPLICATION

This application is a continuation of copending International Application Ser. No. PCT/GB95/01204 file May 26, 1995, and published as WO 95/32659 on Dec. 7, 1995.

The present invention is concerned with a sanitary unit for collecting human waste for subsequent disposal. Such a sanitary unit may be in the form of a commode or potty assembly, for example such as may be used by invalids or infirm persons or by children.

The majority of potties are a simple bucket shape with a contoured top to fit the child's body. Human waste, i.e. faeces and urine, is collected at the bottom of the potty and is subsequently disposed of, for example by pouring into a toilet.

A problem with such potties is that there is no control of noxious odours and with time they can become difficult to clean.

In a similar manner, most commodes for use by invalids or infirm persons are a simple bucket shape, sometimes provided with a top or separate seat for a person to sit on. Similar problems of odour control and cleaning can arise with such commodes.

It is therefore an object of the present invention to provide a sanitary unit which can reduce noxious odours and/or can be easier to clean.

According to the present invention there is provided a sanitary unit comprising a container for receiving human waste, seat means disposed relative to the container such that waste from a person sitting on the seat means is received in the container, a water reservoir communicating with the container by way of valve means, and valve actuating means responsive to the weight of a person sitting on the seat means so as to open the valve means and release water from the reservoir into the container in response to a person sitting on the seat means.

The reservoir may be mounted on a base, the seat means being movable relative to the base and being connected to the valve actuating means so as to open the valve means and release water from the reservoir into the container in response to a person sitting on the seat means.

The valve may incorporate a closable flexible tube communicating between the reservoir and the container for the passage of water from the reservoir to the container and the valve actuating means may comprise lever means secured to the container and biased towards the flexible tube for closing the tube. The lever means may comprise an inlet channel provided on the container for receiving water from the flexible tube.

Alternatively, the valve means may comprise an outlet aperture provided in the reservoir and a valve closure element movable towards and away from the aperture and the valve actuating means may comprise lever means secured to the container and biased in a direction to urge the valve closure element towards the outlet aperture. The lever means may comprise an inlet channel provided on the container for receiving water from the outlet aperture.

The container may be secured to the base and be movable relative thereto due to flexing between the base and the container. The container may be secured to the base in a region of both thereof remote from the reservoir.

The sanitary unit may include means for limiting movement of the container relative to the base. The limiting means may comprise stop means provided on the base. Alternatively, the container may be dimensioned such that movement of the container relative to the base is limited by engagement of the container with a surface on which the unit is disposed.

For a better understanding of the present invention and to show more clearly how it may be carried into effect reference will now be made, by way of example, to the accompanying drawings in which:

FIG. 1 is a diagrammatic cross-sectional view of one embodiment of a sanitary unit according to the present invention in use;

FIG. 2 is a diagrammatic cross-sectional view of another embodiment of a sanitary unit according to the present invention;

Figure 3:
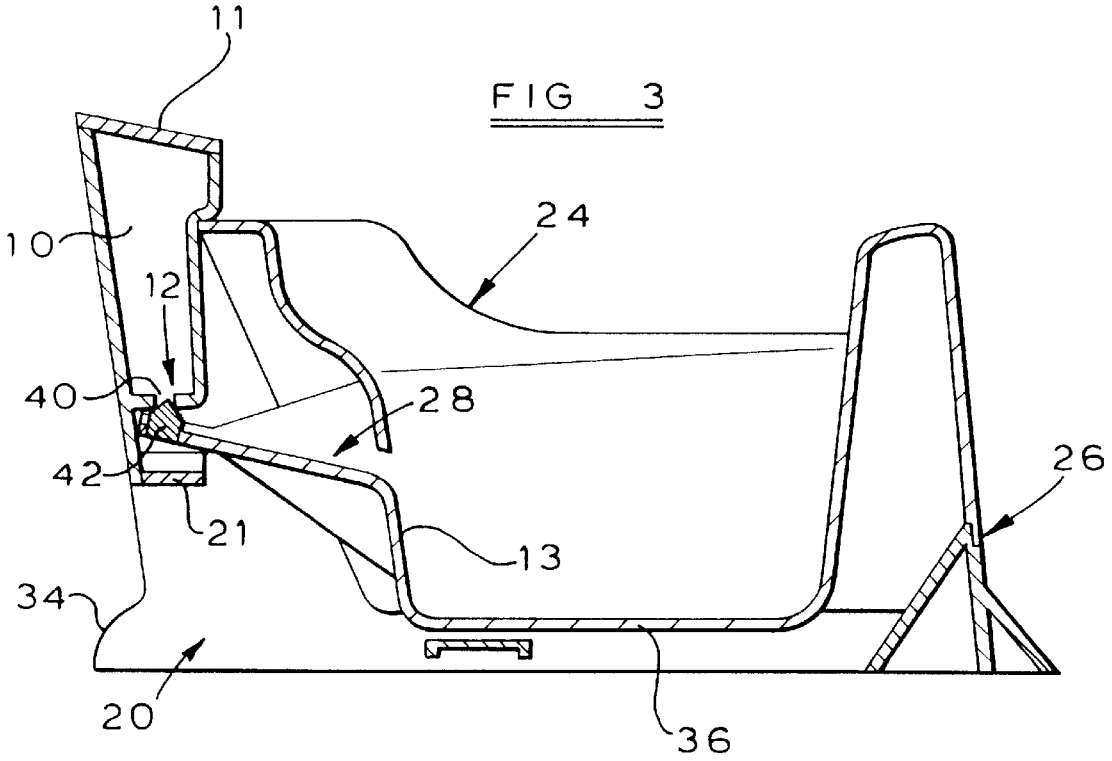
FIG. 3 is a diagrammatic cross-sectional view of a further embodiment of a sanitary unit according to the present invention.

FIG. 1 shows a sanitary unit in the form of a child's potty comprising a water reservoir 10 with a cap 11, a valve 12 and a container or bowl 13 for receiving human waste. If desired, perfume or a bactericide can be added to the water in the reservoir, for example in the form of a slowly dissolving block which may be held, for example, in a permeable pocket (not shown) within the reservoir.

In use, the reservoir 10 is filled with water, the cap 11 is put in place and the sanitary unit is placed onto a suitable surface for use by the user(s).

When the unit is sat upon by a user, the weight of the user opens the valve 12 and water flows from the reservoir 10 into the bowl 13 so as to provide a predetermined volume of water in the bowl.

Once the user has finished and moved from the sanitary unit, the water and waste in the bowl 13 can be removed and the bowl 13 cleaned. The water reservoir 10 is then filled or topped up, the reservoir cap 11 is put in place and the unit is ready for use once again.

It will be appreciated that account should be taken of the expected weight of the user. Thus, if the sanitary unit is to be used as a potty for a child then the weight activation threshold should be quite low.

The sanitary unit of the present invention may conveniently be an integrated unit to allow easy transport. Moreover, the unit may be weighted or may be appropriately dimensioned to reduce the likelihood of it tipping over during use.

FIG. 2 shows a sanitary unit in the form of a child's potty operating on the principles described in relation to the sanitary unit of FIG. 1 and comprising a reservoir 10 which, in use, is filled with water in the manner described above and then closed with a cap 11.

The reservoir is mounted above a base 20 by means of a supporting member 21 and is provided in the lower region thereof with an outlet tube 22. Also mounted on the base 20 is a bowl 13 which incorporates a seat 24 for the user. The bowl 13 is secured to the base 20 in a manner which permits movement of the bowl, and thus the seat, relative to the base in a manner to be described in more detail hereinafter. For example, the bowl and the base may be made of plastics materials secured together, for example by welding, in a region 26 where they adjoin, the region 26 preferably being remote from the reservoir 10.

The bowl 13 is formed with an inlet channel 28 which protrudes from the bowl towards the reservoir 10. An upper surface 30 of the inlet channel engages with the outlet tube 22, the outlet tube being formed of a flexible material at least in the region where it is engaged by the upper surface of the inlet channel, and urges the flexible tube upwardly against part 32 of supporting member 21 for the reservoir 10 so as to close the flexible part of the outlet tube 22 and form a valve 12.

The base 20 is provided with an inclined edge 34 in a region thereof remote from the region 26 to engage with the bowl 13 and urge the sides of the bowl apart.

In use of the sanitary unit of FIG. 2, the reservoir 10 is filled with water, the cap 11 is put in place and the sanitary unit is placed onto a suitable surface for use by the user(s).

When a user sits on the seat 24 of the unit, the weight of the user causes the bowl 13 to flex relative to the base 20 and to pivot about the region 26. Pivoting of the bowl 13 causes the upper surface 30 of the inlet channel 28 to move away from the part 32 of supporting member 21 and to allow the flexible part of the outlet tube 22 to open and water flows from the reservoir 10 into the bowl 13 so as to provide a predetermined volume of water in the bowl.

Flexing of the bowl 13 relative to the base 20 is limited because as the bowl flexes the sides of the bowl are urged progressively apart by the inclined edge 34 of the base and this progressive spacing of the sides of the bowl 13 progressively increases resistance to further movement. Thus, resistance to initial flexing of the bowl 13 relative to the base 20 is relatively low, but increases progressively as flexing increases and therefore it is relatively easy for a young child to open the valve 12, but relatively difficult for an older, and heavier, child to flex the bowl excessively. In any event, if desired the base and/or the bowl can be provided with means to limit relative flexing, for example by engagement between the bottom 36 of the bowl and the base or by engagement between the sides of the bowl and the surface on which the unit is placed.

Once the user has finished and moved away from the unit, the water and waste in the bowl 13 can be removed and the bowl 13 cleaned. The water reservoir is then filled or topped up, the reservoir cap 11 is put in place and the unit is ready for use once again.

FIG. 3 shows a sanitary unit in the form of a child's potty similar to that shown in FIG. 1 and comprising a reservoir 10 which, in use, is filled with water in the manner described in relation to FIG. 1 and then closed with a cap 11.

The reservoir is mounted above a base 20 by means of a supporting member 21 and is provided in the lower region thereof with an outlet 40. Also mounted on the base 20 is a bowl 13 which incorporates a seat 24 for the user. As with the embodiment of FIG. 2, the bowl 13 is secured to the base 20 in a manner which permits movement of the bowl, and thus the seat, relative to the base. For example, the bowl and the base may be made of plastics materials secured together, for example by welding, in a region 26 where they adjoin, the region 26 preferably being remote from the reservoir 10.

The bowl 13 is formed with an inlet channel 28 which protrudes from the bowl towards the reservoir 10. The region of the end of the inlet channel 28 remote from the bowl 13 is provided with a flexible seal 42 which is urged upwardly towards the underside of the reservoir 10 so as to close the outlet 40 of the reservoir and form a valve 12.

As an alternative to the flexible seal being provided on the inlet channel 28, the outlet 40 of the reservoir may be provided with a flexible valve seat which engages with valve closure means provided on the inlet channel.

The base 20 is provided with an inclined edge 34 especially in a region thereof remote from the region 26 to engage with the bowl 13 and urge the sides of the bowl apart.

In use of the sanitary unit of FIG. 3, the reservoir 10 is filled with water, the cap 11 is put in place and the sanitary unit is placed onto a suitable surface for use by the user(s).

When a user sits on the seat 24 of the unit, the weight of the user causes the bowl 13 to flex relative to the base 20 and to pivot about the region 26. Pivoting of the bowl 13 causes the flexible seal 42 to move away from the outlet 40 of the reservoir thus allowing the valve 12 to open and water flows from the reservoir 10 into the bowl 13 so as to provide a predetermined volume of water in the bowl.

Flexing of the bowl 13 relative to the base 20 is limited because as the bowl flexes the sides of the bowl are urged progressively apart by the inclined edge 34 of the bases and this progressive spacing of the sides of the bowl 13 progressively increases resistance to further movement. Thus, resistance to initial flexing of the bowl 13 relative to the base 20 is relatively low, but increases progressively as flexing increases and therefore it is relatively easy for a young child to open the valve 12, but relatively difficult for an older, and heavier, child to flex the bowl excessively. In any event, the base and/or the bowl can be provided with means to limit relative flexing, for example by engagement between the bottom 36 of the bowl and the base or by engagement between the sides of the bowl and the surface on which the unit is placed.

Once the user has finished and moved away from the unit, the water and waste in the bowl 13 can be removed and the bowl 13 cleaned. The water reservoir is then filled or topped up, the reservoir cap 11 is put in place and the unit is ready for use once again.

Figure 4:
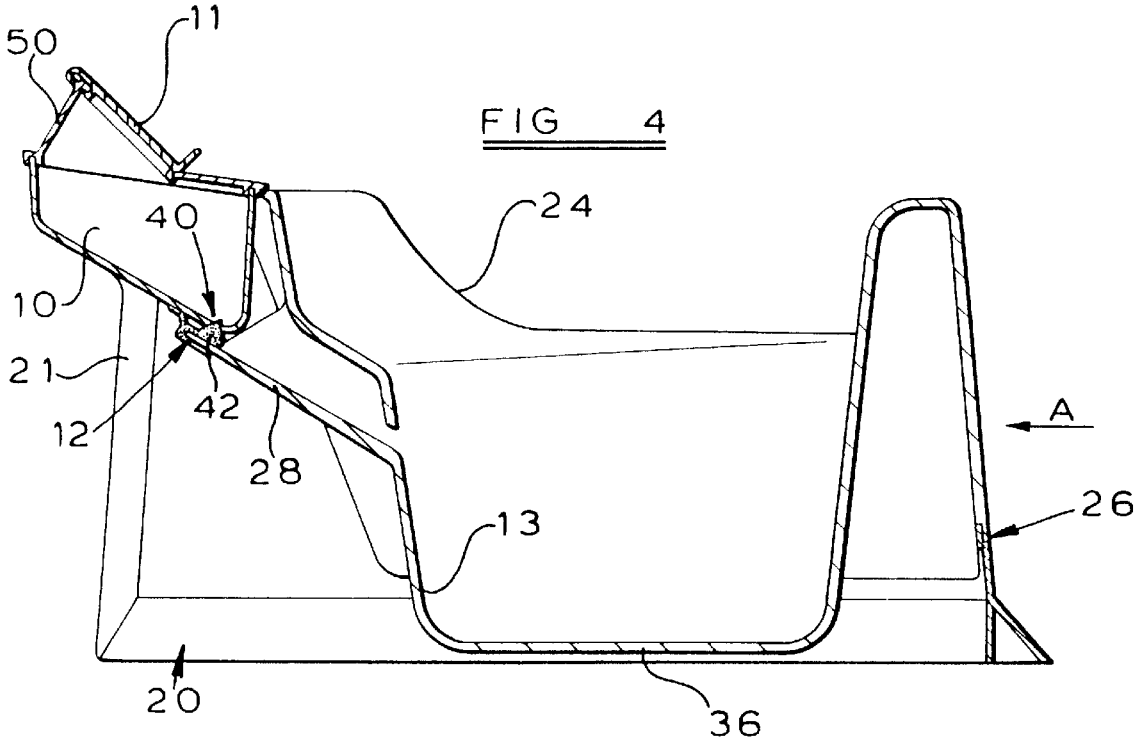
FIG. 4 is a diagrammatic cross-sectional view of yet a further embodiment of a sanitary unit according to the present invention.
Figure 5:
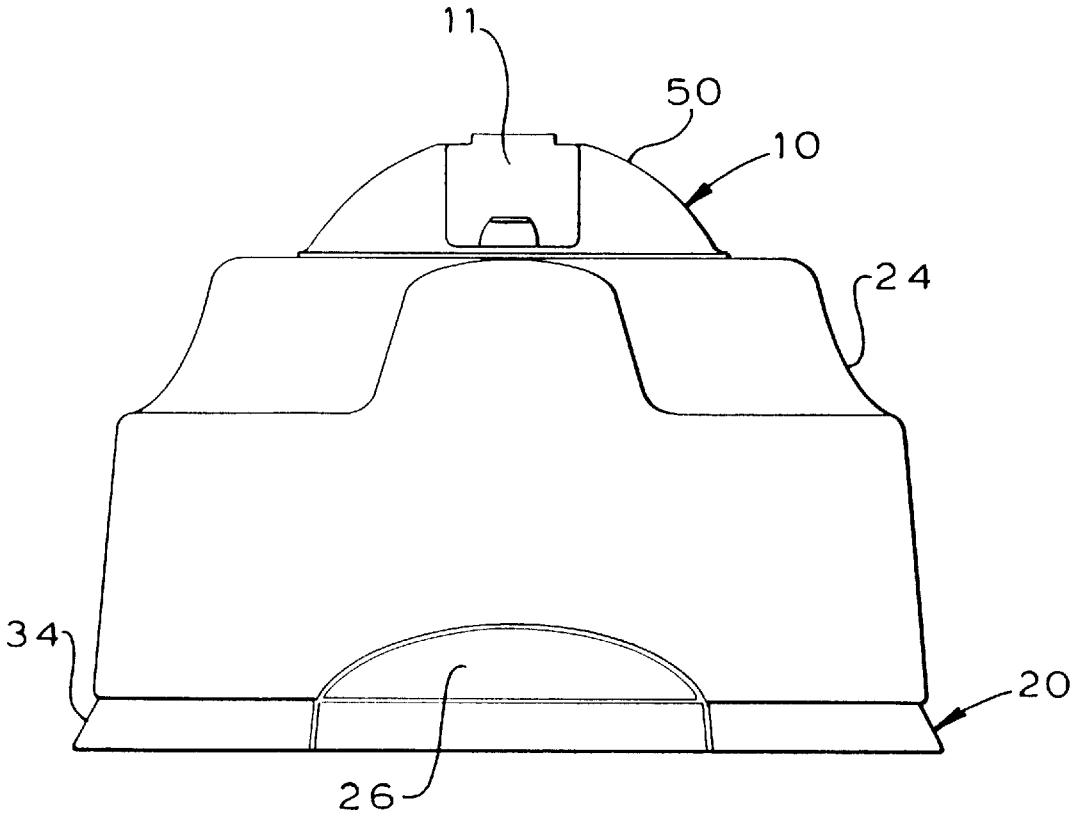
FIG. 5 is an elevational view of the sanitary unit shown in FIG. 4 looking in the direction of the arrow A in FIG. 4.

FIGS. 4 and 5 show a sanitary unit in the form of a child's potty similar to that shown in FIG. 3 and comprising a reservoir 10 which, in use, is filled with water in the manner described in relation to FIG. 1 and then closed with a cap 11 provided in a cover 50.

The reservoir is mounted above a base 20 by means of a supporting member 21 and is provided in the lower region thereof with an outlet 40. Also mounted on the base 20 is a bowl 13 which incorporates a seat 24 for the user. As with the embodiment of FIG. 3, the bowl 13 is secured to the base 20 in a manner which permits movement of the bowl, and thus the seat, relative to the base. In this respect, the bowl and the base may be made of plastics materials secured together, for example by welding, in a region 26 where they adjoin, the region 26 preferably being remote from the reservoir 10.

The bowl 13 is formed with an inlet channel 28 which protrudes from the bowl towards the reservoir 10. The region of the end of the inlet channel 28 remote from the bowl 13 is provided with a flexible seal 42 which is urged upwardly towards the underside of the reservoir 10 so as to close the outlet 40 of the reservoir and form a valve 12.

As an alternative to the flexible seal being provided on the inlet channel 28, the outlet 40 of the reservoir may be provided with a flexible valve seat which engages with valve closure means provided on the inlet channel.

The base 20 is provided with an inclined edge 34 especially in a region thereof remote from the region 26 to engage with the bowl 13 and urge the sides of the bowl apart.

The base 20 of the sanitary unit shown in FIGS. 4 and 5 is incomplete in that it is effectively restricted to a rim around the periphery of the base of the bowl and does not extend beneath the bowl. Such an arrangement has the advantage that it permits stacking of the sanitary units which reduces the storage space requirements.

In use of the sanitary unit of FIGS. 4 and 5, the reservoir 10 is filled with water, the cap 11 is put in place and the sanitary unit is placed onto a suitable surface for use by the user(s).

When a user sits on the seat 24 of the unit, the weight of the user causes the bowl 13 to flex relative to the base 20 and to pivot about the region 26. Pivoting of the bowl 13 causes the flexible seal 42 to move away from the outlet 40 of the reservoir thus allowing the valve 12 to open and water flows from the reservoir 10 into the bowl 13 so as to provide a predetermined volume of water in the bowl.

Flexing of the bowl 13 relative to the base 20 is limited because as the bowl flexes the sides of the bowl are urged progressively apart by the inclined edge 34 of the base and this progressive spacing of the sides of the bowl 13 progressively increases resistance to further movement. Thus, resistance to initial flexing of the bowl 13 relative to the base 20 is relatively low, but increases progressively as flexing increases and therefore it is relatively easy for a young child to open the valve 12, but relatively difficult for an older, and heavier, child to flex the bowl excessively. In any event, the bowl is provided with means to limit relative flexing by engagement between the bottom 36 of the bowl and the surface on which the unit is placed.

Once the user has finished and moved away from the unit, the water and waste in the bowl 13 can be removed and the bowl 13 cleaned. The water reservoir is then filled or topped up, the reservoir cap 11 is put in place and the unit is ready for use once again.

Thus, the sanitary unit according to the present invention provides a predetermined amount of water in the bottom of the waste-receiving bowl. The water not only suppresses odours, but also makes the bowl more easy to clean.

Although the sanitary unit of the present invention has been described and illustrated in respect of a child's potty, the present invention is also applicable to commodes for the elderly or infirm and offers the same advantages of odour control and being more readily cleaned.

We claim:

1. A sanitary unit comprising a container and a base, said container including opposite sidewall portions, a bowl portion disposed between said sidewall portions for receiving human waste, a seat means, said seat means being so disposed relative to said bowl portion that waste from a person sitting on the seat means is received in the bowl portion, said container being movable relative to the base as a result of a person sitting on said seat means; said unit further comprising a water reservoir communicating with the bowl portion by way of valve means, and valve actuating means responsive to the weight of a person sitting on the seat means so as to open the valve means and release water from the reservoir into the bowl portion of the container in response to a person sitting on the seat means, the base being provided with an inclined edge to engage with the container and to urge said sidewall portions of the container apart in response to movement of the container relative to the base as a result of a person sitting on the seat means.

2. A sanitary unit as claimed in claim 1, wherein the reservoir is mounted on the base.

3. A sanitary unit as claimed in claim 2, wherein the valve means incorporates a closable flexible tube communicating between the reservoir and the container for the passage of water from the reservoir to the container bowl portion and the valve actuating means comprises lever means secured to the container and biased towards the flexible tube for closing the tube.

4. A sanitary unit as claimed in claim 3, wherein the lever means comprises an inlet channel provided on the container for receiving water from the flexible tube.

5. A sanitary unit as claimed in claim 2, wherein the valve means comprises an outlet aperture provided in the reservoir and a valve closure element movable towards and away from the aperture and the valve actuating means comprises lever means secured to the container and biased in a direction to urge the valve closure element towards the outlet aperture.

6. A sanitary unit as claimed in claim 5, wherein the lever means comprises an inlet channel provided on the container for receiving water from the outlet aperture.

7. A sanitary unit as claimed in claim 2 wherein the container is secured to the base and is movable relative thereto due to flexing between the base and the container.

8. A sanitary unit as claimed in claim 7, wherein the container is secured to the base in a region that is remote from the reservoir.

9. A sanitary unit as claimed in claim 2 and including means for limiting movement of the container relative to the base.

10. A sanitary unit as claimed in claim 9, wherein the container is dimensioned such that movement of the container relative to the base is limited by engagement of the container with a surface on which the unit is disposed.

* * * * *